US008464796B2

(12) United States Patent
Hoefel et al.

(10) Patent No.: US 8,464,796 B2
(45) Date of Patent: Jun. 18, 2013

(54) FLUID RESISTIVITY MEASUREMENT TOOL

(75) Inventors: Albert Hoefel, Sugar Land, TX (US); Kent D. Harms, Richmond, TX (US); Michael J. Stucker, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 302 days.

(21) Appl. No.: 12/849,327

(22) Filed: Aug. 3, 2010

(65) Prior Publication Data

US 2012/0031610 A1 Feb. 9, 2012

(51) Int. Cl.
*E21B 43/36* (2006.01)

(52) U.S. Cl.
USPC ..... 166/336; 166/250.1

(58) Field of Classification Search
USPC ..... 166/336, 250.1; 324/693, 366, 369; 73/152.18, 152.23, 152.24
See application file for complete search history.

(56) References Cited

U.S. PATENT DOCUMENTS

| | | | |
|---|---|---|---|
| 2,869,071 | A | 1/1959 | Esterson |
| 3,419,796 | A | 12/1968 | Brown |
| 4,860,581 | A | 8/1989 | Zimmerman et al. |
| 4,936,139 | A | 6/1990 | Zimmerman et al. |
| 6,641,434 | B2 | 11/2003 | Boyle et al. |
| 6,986,282 | B2 | 1/2006 | Ciglenec et al. |
| 7,114,562 | B2 | 10/2006 | Fisseler et al. |
| 7,183,778 | B2 | 2/2007 | Homan et al. |
| 7,458,419 | B2 | 12/2008 | Nold, III et al. |

*Primary Examiner* — William P Neuder
*Assistant Examiner* — Ronald Runyan
(74) *Attorney, Agent, or Firm* — Cathy Hewitt; John Vereb

(57) ABSTRACT

A downhole tool configured for conveyance within a borehole extending into a subterranean formation, wherein the downhole tool comprises a sensor assembly comprising a housing, a cap coupled to an end of the housing, a flow-line tube disposed within the housing and configured to receive fluid from the formation, a first winding disposed within the housing and configured to induce an electrical current in the fluid, and a second winding disposed within the housing and configured to detect the electrical current induced in the fluid by the first winding.

18 Claims, 11 Drawing Sheets

FLUID RESISTIVITY MEASUREMENT TOOL

BACKGROUND OF THE DISCLOSURE

Wellbores are drilled into the Earth's formation to recover deposits of hydrocarbons and other desirable materials trapped in the formations below. Typically, a wellbore is drilled by connecting a drill bit to the lower end of a series of coupled sections of tubular pipe known as a drillstring. Drilling fluids, or mud, are pumped down through a central bore of the drillstring and exit through ports located at the drill bit. The drilling fluids act to lubricate and cool the drill bit, to carry cuttings back to the surface, and to establish sufficient hydrostatic "head" to prevent formation fluids from "blowing out" the borehole once they are reached.

To sample and test fluids, such as deposits of hydrocarbons and other desirable materials trapped in the formations, a formation tester is typically deployed in the wellbore drilled through the formations. Various formation fluid testers for wireline and/or logging-while-drilling applications are known in the art, such as those described in U.S. Pat. Nos. 4,860,581, 4,936,139, and 7,458,419. The entireties of these patents are hereby incorporated herein.

One characteristic of interest of a formation fluid may be the electrical resistivity of the fluid. Resistivity of fluids passing through a flow line of the formation fluid testers may be measured. Sensors configured to measure the resistivity of fluids within the flow line include, for example, those described in U.S. Pat. No. 7,183,778, the entirety of which is incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
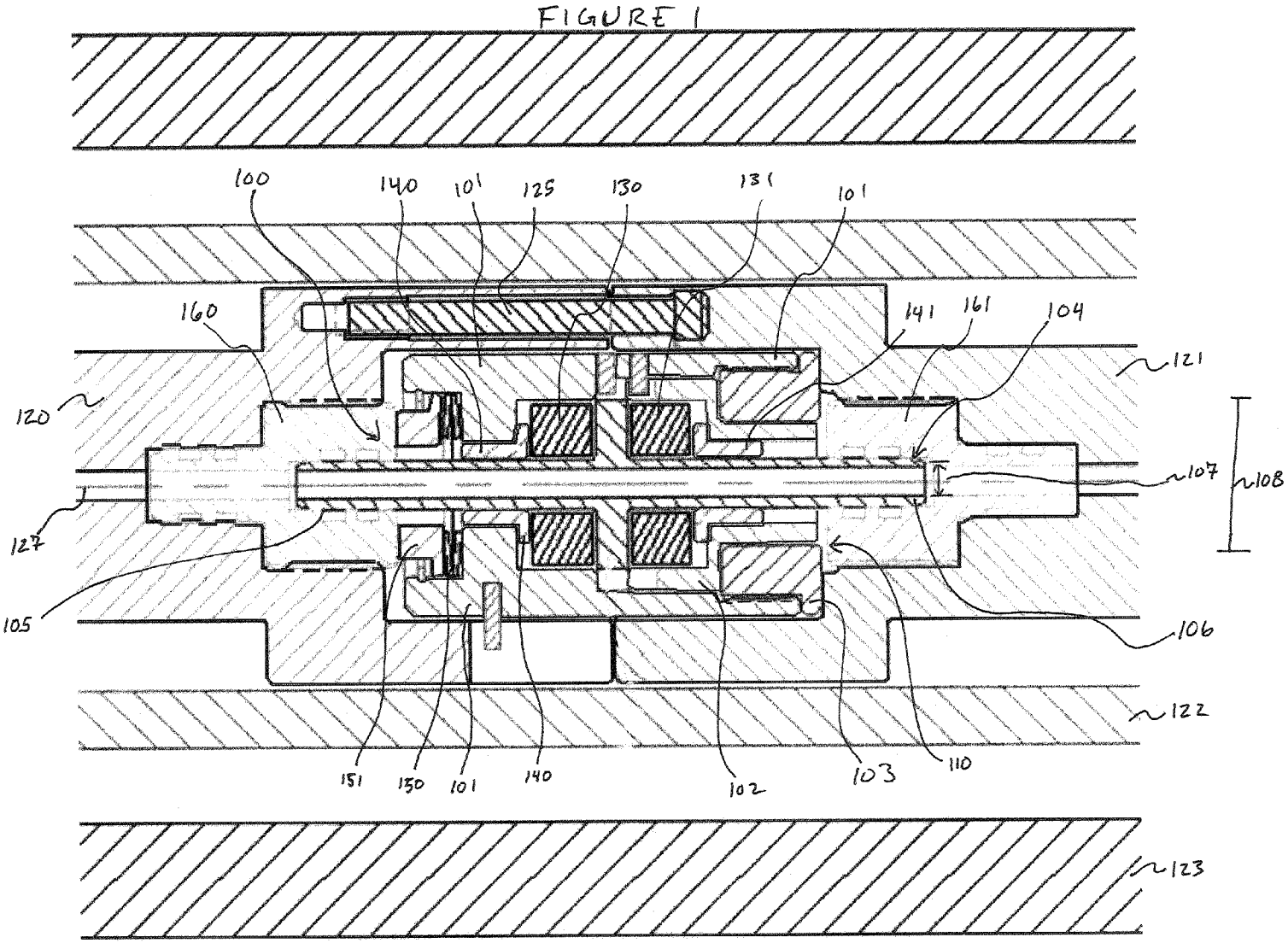
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure provides a modular apparatus that is configured to accurately measure resistivity of fluids flowing within a flow line. The modular apparatus is suitable for use with high pressure and/or high temperature fluids, such as fluids typically measured in formation fluid testers. The modular apparatus is simple to construct, install, repair, and/or service.

An apparatus in accordance with one or more aspects of the present disclosure may include a housing and a cap. The housing may provide a shell that houses inner elements of the apparatus, such as, windings, flow-line tubes, isolators, and other elements discussed herein. The cap may provide an enclosure on an end of the housing to protect the inner elements of the apparatus. The cap may be removably attached to the housing by a threaded connection, but may also be attached by other means, such as jam nuts, clips, bolts, screws, and/or other locking and/or enclosing means. The removably attached cap may be configured to allow easy construction, installation, repair, and/or servicing of the apparatus and elements thereof.

Within the housing and the cap may be a flow-line tube. The flow-line tube may be configured to allow fluid to flow into and/or through the apparatus. Accordingly, the flow-line tube may be in fluid communication with one or more flow lines of a downhole tool in which the apparatus may be installed.

Also within the housing and the cap may be a pair of windings, such as toroidal solenoids, positioned around the flow-line tube and adjacent thereto. For example, the windings may be configured to slide on an external surface of the flow-line tube. A first winding may be configured to induce an electrical current in fluid located within the flow-line tube. A second winding may be configured to detect the magnitude of the electrical current induced in the fluid located within the flow-line tube, thereby permitting a measurement of resistivity of the fluid. For example, the first winding may be excited by an electrical power source. The electrical current induced in the fluid may flow through the fluid located within the flow-line tube. A return path for the electrical current induced in the fluid may be provided by a chassis that may hold the apparatus. The chassis may be made of an electrically conductive material and/or a non-magnetic material. The induced current may in turn generate a current and/or voltage in the second winding.

Accordingly, the first winding may induce a current and/or voltage in the fluid within the flow-line tube and the second winding may detect the magnitude current and/or voltage induced in the fluid to determine a resistivity of the fluid. For example, the resistivity of the fluid may be calculated and/or determined based on the current and/or voltage generated in the second winding. The second winding may electrically react proportionally or otherwise predictably to the current induced in the fluid. The current and/or voltage generated in or detected by the second winding may be measured. The second winding may be electrically connected to electrical components and/or detectors of the apparatus. A signal, such as a digital signal, provided by the electrical components and/or detectors may be used to calculate and/or determine the resistivity of the fluid.

The flow-line tube may be electrically insulated and/or electrically resistant so as to prevent current leaks, and/or to provide accurate resistivity measurements. The flow-line tube may be formed from two separate components and/or layers. A first component or layer may be rigid and possibly metallic. A second component or layer may be an electrically insulated coating and/or surface. The second component may form an inner surface of the flow-line tube that may be in physical contact with the fluid within the flow-line tube. The first component may form an outer surface of the flow-line tube that may provide rigidity and structural support against fluid pressure. Alternatively, the flow-line tube may be formed from a single unitary rigid and electrically insulated material. The flow-line tube may comprise materials selected to withstand corrosive wellbore fluids, drilling fluids, formation fluids, and/or other potentially corrosive compositions.

Seals may be disposed on opposing sides/ends of the flow-line tube. Such seals may be identical in size, such as to create a pressure balance across the flow-line tube to thereby allow the device to be capable of operating in very high pressures.

The flow-line tube may have a first outer diameter portion and a second outer diameter portion. For example, the second outer diameter portion may be provided with an electrically insulated ring and/or flange that may be part of the flow-line tube or may be an independent piece. The second outer diameter portion may be configured to minimize and/or prevent electrical interaction between the two windings other than through the fluid located within the flow-line tube. Therefore, the second outer diameter portion may increase the sensitivity of the current and/or voltage measured in the second winding to the resistivity of the fluid in the flow-line tube. Accordingly, the first winding may be positioned on the flow-line tube at a first position about the first outer diameter portion, and the second winding may be positioned on the flow-line tube at a second position about the first outer diameter portion, wherein the second outer diameter portion of the flow-line tube is located between the first and the second positions.

Alternatively, the flow-line tube may include first and second insulated portions separated by at least one conductive portion therebetween. The resistivity of the fluid within the flow-line tube may be determined and/or measured by conduction instead of induction. The conductive portion may be in direct contact with the fluid within the flow-line tube and may be configured to directly inject an electrical current into the fluid. A voltmeter and/or an ampere meter may be configured to measure the resistivity of the fluid. Therefore, the windings, among other features described above, may not be necessary.

The housing and cap, containing the flow-line tube, may be configured to fit between a first chassis and a second chassis within a downhole tool. The first chassis and the second chassis may be removably connected by threaded connection and/or other connection means. The first and second chassis may provide the return path for the electrical current induced in the fluid located within the flow-line tube. The chassis may be made of an electrically conductive material and/or a non-magnetic material. The first and second chassis may each have a flow line passing therethrough. The flow lines of the first and second chassis may be fluidly coupled to the flow-line tube.

One or more adapters may be positioned between the housing and the first chassis and/or between the cap and the second chassis. The adapters may be configured to provide a fluid and/or pressure seal between the flow-line tube of the apparatus and the flow lines of the first and second chassis. The adapters may be further configured to provide electrical insulation to ends of the flow-line tube. The adapters may have flow lines disposed therethrough, fluidly connecting the flow-line tube to the flow lines of the first and second chassis. For example, the adapters may be implemented with stabbers and/or other adapters. The connections between the flow-line tube ends and the adapters and/or between the adapters and the first or second chassis may be fluidly sealed by O-rings and/or other fluidly sealing means. Alternatively, the housing and cap may directly connect with the first and second chassis or the adapter may be an integral part of the apparatus such that a separate adapter is not necessary for connecting the flow lines of the chassis with the flow-line tube.

A biasing mechanism may be provided between the housing and/or cap and the first and second chassis. The biasing mechanism may be configured to allow the apparatus to move and/or thermally expand within a downhole tool without causing damage to the apparatus. For example, during drilling and/or operation, the downhole tool may be subject to vibrations and other movements that may adversely impact components disposed within the downhole tool, such as the apparatus. The biasing mechanism may absorb vibrations such that damage does not occur to the apparatus. The biasing mechanism may be a moveable spacer, a spring spacer and/or other biasing mechanisms, such as one or more Belleville washers or other springs or washers.

The housing and cap, containing the flow-line tube, may be installed within a downhole tool, for example within a pressure housing. The pressure housing may further be installed within a drill collar of a downhole tool, thereby packaging the apparatus within the downhole tool. The pressure housing may protect the apparatus from the harsh environment in which downhole tools may be operated, such as from downhole pressures and/or downhole fluids.

Referring to FIG. 1, a schematic view is shown of an apparatus 100 in accordance with one or more aspects of the present disclosure. The apparatus 100 may include a housing 101 and a cap 110. The cap 110 may be removably attached to the housing 101, thereby defining an enclosure. The cap 110 may be press-fitted (via interference fit), threadedly connected, or otherwise permanently or removably connected to the housing 101. As shown, the cap 110 may include a cover 102 and a jam nut 103. The jam nut 103 may hold the cover 102 in engagement with the housing 101 by holding the cap 102 within an open end of the housing 101. Alternatively, the cap 110 may be a single unitary piece threadedly or otherwise removably or permanently connected to the housing 101.

A flow-line tube 104 may be disposed within the apparatus 100 and held within the housing 101 and the cap 110. A first end 105 and a second end 106 of the flow-line tube 104 may extend outside of the housing 101 and the cap 110. The flow-line tube 104 may define an axis 127. The flow-line tube 104 may comprise one or more materials selected to resist or withstand exposure to corrosive fluids. For example, the flow-line tube 104 may at least partially comprise stainless steel, Inconel, and/or other corrosion-resistant materials.

Within the enclosure defined by the housing 101 and the cap 110, a first winding 130 and a second winding 131 may be located adjacent to the flow-line tube 104. The first winding 130 may be located at a first position along the flow-line tube 104 and the second winding 131 may be located at a second position along the flow-line tube 104. The first winding 130 may be electrically connected to an electrical source (not shown) that may be configured to have the first winding 130 induce an electrical current within a fluid that may be within the flow-line tube 104. The magnitude of the electrical current in the fluid may be affected by the resistivity of the fluid. The electrical current in the fluid within the flow-line tube may then induce a current within the second winding 131. The current induced within the second winding 131 may be detected by a detector (not shown) electrically coupled to the second winding 131. By measuring the current in the second winding 131, and knowing the current supplied to the first winding 130, the resistivity of the fluid within the flow-line tube may be determined.

To avoid direct electromagnetic interferences from the first winding 130, an insulator may be located between the first winding 130 and the second winding 131. The insulator may be part of the flow-line tube 104. For example, the flow-line tube 104 may have two portions having different outer diameters, such as a first outer diameter 107 and a second outer diameter 108. The first diameter 107 may be smaller than the second diameter 108, as shown in FIG. 1. The portion of the flow-line tube having the second diameter may provide electromagnetic insulation between the first winding 130 and the second winding 131. The portion of the flow-line tube 104 having the second diameter 108 and the portion of the flow-line tube 104 having the first diameter 107 may be parts of an integral piece. Alternatively, the portion of the flow-line tube 104 having the second diameter 108 may be an independent piece that may be permanently or removably connected to the flow-line tube 104. Alternatively still, the independent piece may not attach to the flow-line tube 104, and may merely be placed between the first winding 130 and the second winding 131 along the flow-line tube 104.

Insulators 140 and 141 may be provided adjacent to the flow-line tube 104 and may contribute to prevent capacitive leakage across the flow-line tube 104. The insulator 140 may be located adjacent to the housing 101 and the first winding 130. The insulator 141 may be located adjacent to the cap 110 and the second winding 131.

The flow-line tube 104 may extend outside of the housing 101 and the cap 110, as shown in FIG. 1. A first end 105 of flow-line tube 104 may extend out of the housing 101. A second end 106 of flow-line tube 104 may extend out of the cap 110. Adapters 160 and 161 may sealingly engage with the ends 105 and 106, thereby allowing for engagement and coupling with a downhole tool and/or other elements. O-rings, washers, and/or other sealing means may be provided with the adapters 160 and 161 to seal the connection between the flow-line tube 104 of the apparatus 100 and the downhole tool and/or other elements. For example, the adapters 160 and 161 may be configured to fluidly connect the apparatus 100, and the flow-line tube 104, with a first chassis 120 and a second chassis 121, respectively. One or both of the adapters 160, 161 may be configured to function as a seal carrier allowing servicing of seals (e.g., seals 162) without having to disassemble the rest of the apparatus 100. Such disassembly may require recalibration after reassembly.

The first chassis 120 and the second chassis 121 may be configured to house the apparatus 100 and to provide fluid and/or electrical connections between the apparatus 100 and other elements of a downhole tool. The first chassis 120 and the second chassis 121 may be removably connected by a bolt 125; however, other connecting means, such as threaded connection, screws, locks, nuts, and/or other connection means may be used. The first chassis 120 and the second chassis 121 may also cooperate to provide a return path for the electrical current induced in the fluid within the flow-line tube 104. The first chassis 120 and the second chassis 121, containing the apparatus 100 and the adapters 160 and 161, may be located within a pressure housing 122. The pressure housing 122 may be disposed within a drill collar 123 or other portion of a downhole wireline, slickline, coiled tubing, or while-drilling apparatus. The pressure housing 122 may alternatively be a portion of the drill collar 123 or other portion of a downhole apparatus.

The seals 162 between the flow-line tube 104 and the adapters 160, 161 may be substantially similar or identical in size and/or other characteristics, so as to allow a pressure balance across the flow-line tube 104. Additional seals 163 may exist between the adapters 160, 161 and the chassis 120, 121. The seals 163 may be substantially similar or identical in size and/or other characteristics, so as to allow a pressure balance across the flow-line tube 104 and/or the adapters 160, 161.

Shocks, vibrations and/or differential thermal expansions may adversely affect the apparatus 100. Accordingly, a biasing mechanism 150 may be located between the housing 101 and the adapter 160 and/or may be located between the cap 110 and the adapter 161 (not shown). The biasing mechanism 150 may damp movement, vibrations, and/or shocks, and allow length changes of the apparatus 100 relative to the adapters 160 and 161 and the chassis 120 and 121. The biasing mechanism 150 may comprise one or more springs, Belleville washers, and/or other types of biasing members. The biasing mechanism 150 may comprise a spacer 151 configured to extend from the housing 101 and abut against the adapter 160. The biasing mechanism 150 may alternatively comprise a pressure-activated biasing means, such as a bladder or other volume that is charged with a predetermined pressure, perhaps by nitrogen and/or other inert gases.

Figure 2B:
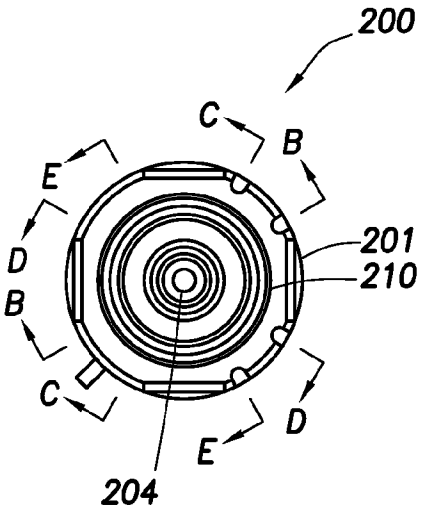
FIGS. 2A and 2B are schematic views of apparatus according to one or more aspects of the present disclosure.
Figure 2A:
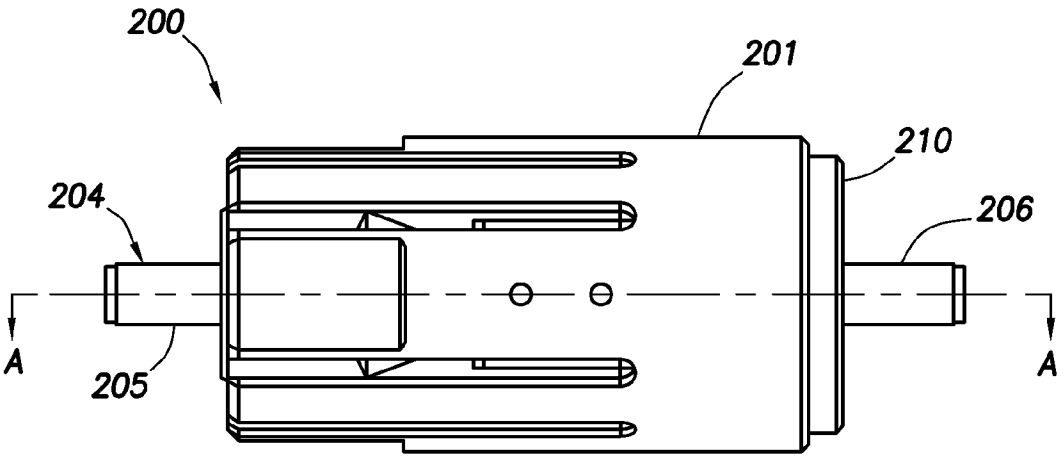
Figure 3:
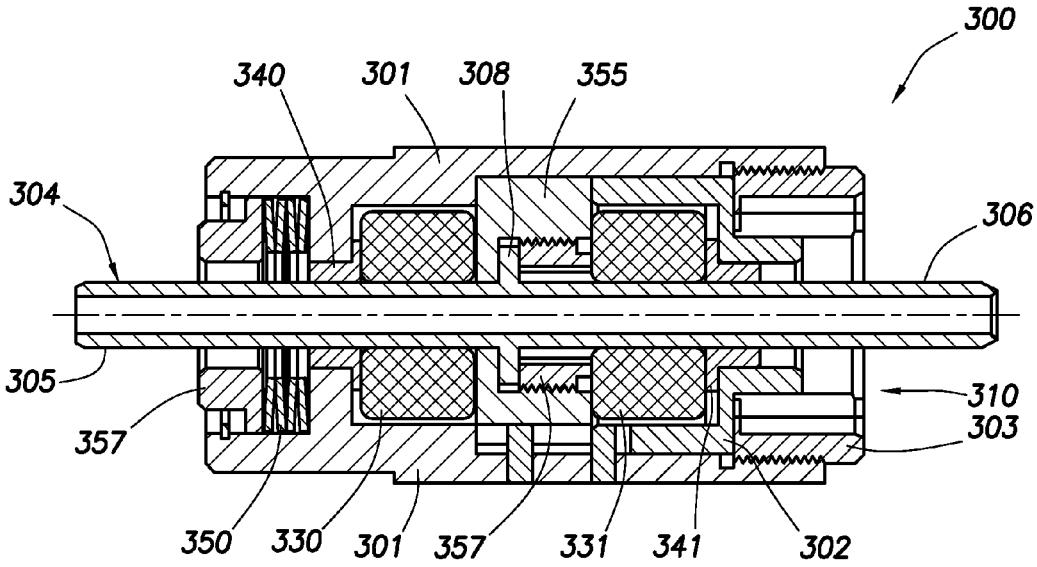
FIG. 3 is a schematic view of apparatus according to one or more aspects of the present disclosure.

Referring to FIGS. 2A-7, schematic views are shown of the apparatus 100 in accordance with one or more aspects of the present disclosure. In FIGS. 2A-7, the adapters, chassis, electronics chassis pressure housing, and drill collar, as discussed above, are omitted for clarity. FIG. 2A is a side view of the apparatus 100 in accordance with one or more aspects of the present disclosure. FIG. 2B is an end-on view of the apparatus 100 in accordance with one or more aspects of the present disclosure. FIG. 3 is a cross-sectional schematic as viewed from the line A-A in FIG. 2A. FIGS. 4-7 are cross-sectional schematic views from lines B-B, C-C, D-D, and E-E of FIG. 2B, respectively.

Referring to FIGS. 2A and 2B, schematic views are shown of the apparatus 100 in accordance with one or more aspects of the present disclosure. A housing 201 and a cap 210 may be removably connected with a flow-line tube 204 extending therethrough, as described above. Ends 205 and 206 of the flow-line tube 204 may extend externally from the housing 201 and the cap 210, respectively.

Referring to FIG. 3, a cross-sectional schematic view is shown of the apparatus 100 in accordance with one or more aspects of the present disclosure. A housing 301 and a cap 310 including a cover 302 and a jam nut 303 may be provided. A flow-line tube 304 may pass through the center of the housing 301 and the cap 310 and may allow for a fluid to be held within and/or pass through the flow-line tube 304. The flow-line tube 304 may be in fluid communication with a flow line of a downhole tool (not shown), as described above. Ends 305 and 306 of flow-line tube 304 may allow for engagement with adapters and/or chassis and/or other downhole components (not shown), as described above.

A section of flow-line tube 304 may include an outer larger diameter that may be larger than the remainder of the flow-line tube 304. The outer larger diameter may be a second diameter 308 of the flow-line tube 304 that may have a first diameter that may be smaller than the second diameter 308. The second diameter 308 may be an integral part of the flow-line tube 304 or may be an independent component, such as an insulating flange or ring that may be positioned adjacent to the flow-line tube 304 as discussed above. However, the second diameter 308 may not be electrically insulated, such as if the opposing components sandwiching the second diameter 308 are insulated on the outside. This may allow coupling a ground lug (e.g., via tapping and screwing into) to the insulated flange 355 described below, and subsequently testing for leakage.

The flow-line tube 304 may be made of an electrically insulated material or may be made of multiple layers, at least one layer being an electrically insulating layer. As noted above, a fluid may pass through and/or be held within the flow-line tube 304. A first winding 330 may be provided within the housing 301 adjacent to the flow-line tube 304 and may be configured to induce an electrical current within the fluid that may be within the flow-line tube 304. A second winding 331, provided within the housing 301 adjacent to the flow-line tube 304 and secured by the cap 310, may be configured to detect the current induced in the fluid within the flow-line tube 304.

Space or volume outside of the flow-line tube 304 and between the first winding 330 and the second winding 331 may be made electrically non conductive. As such, components of the apparatus 100 may be electrically insulated and/or made of an electrically non conductive material. For example, the flow-line tube 304 may be made of and/or coated with an electrically non conductive material. Additional elements may be provided to make the space or volume outside of the flow-line tube 304 and between the first winding 330 and the second winding 331 non conductive. Insulators 340 and 341 may be provided between the first winding 330 and the housing 301 and between the second winding 331 and the cap 310, respectively.

The second diameter 308 may provide electrical isolation. In addition to the second diameter 308 located between the first winding 330 and the second winding 331, an electrically insulated flange 355 may be provided within the housing 301 and the cap 310. A small jam nut 357 may also be provided to connect to the flange 355 and engage therewith.

The apparatus 100 may be provided with a biasing mechanism 350 that may allow for the apparatus 100 to damp vibrations or shocks, such as due to operation of the downhole tool and/or a drill bit. The biasing mechanism 350 may be or comprise one or more springs, Belleville washers, and/or other biasing members. As shown in FIG. 3, the biasing mechanism 350 is in a compressed state. A spacer 351 may be provided against which the biasing mechanism 350 may be biased. The spacer 351 may allow for additional freedom of movement of the apparatus 100 within a downhole tool, and may provide electrical isolation for the components of the apparatus 100.

Figure 4:
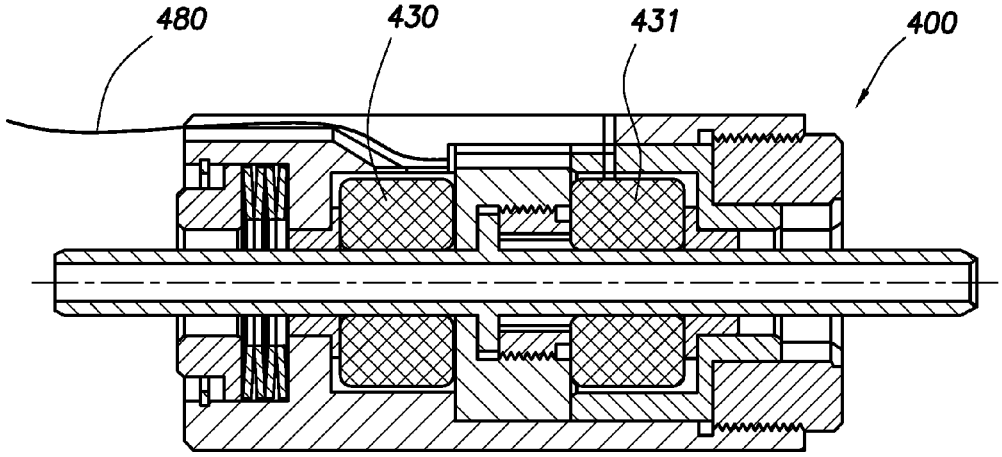
FIG. 4 is a schematic view of apparatus according to one or more aspects of the present disclosure.

Referring to FIG. 4, a cross-sectional schematic view is shown of the apparatus 100, taken along line B-B of FIG. 2B. As shown, an electrical wire bundle 480 may be provided that may conduct a current within a first winding 430. The electrical wire bundle 480 may also allow for electrical signals to be conducted from a second winding 431 to a detector. Alternatively, the electrical source 480 may be an electrical line and/or wire that may detect a current and/or a voltage in the first winding 430 and/or the second winding 431.

Figure 5:
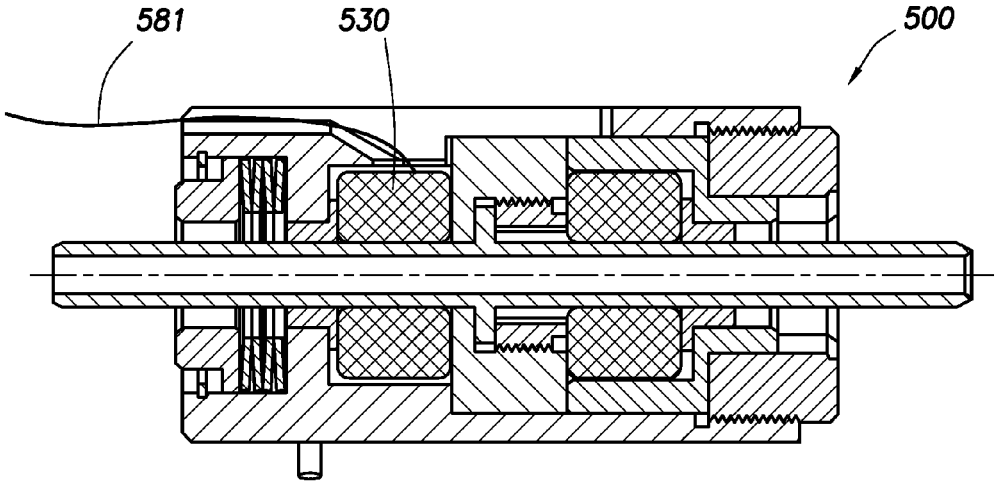
FIG. 5 is a schematic view of apparatus according to one or more aspects of the present disclosure.

Referring to FIG. 5, a cross-sectional schematic view is shown of an apparatus 100, taken along line C-C of FIG. 2B. As shown, an electrical wire bundle 581 may be provided that may conduct a current within a first winding 530. The second electrical wire bundle 581 may be connected to the first winding 530, thereby providing the induction current, and may be electrically insulated and/or isolated from other wires and/or electrical sources within the apparatus 100.

One or more detectors may be disposed within the apparatus. The detectors may include thermal detectors, electrical detectors, voltage detectors, current detectors, and/or electrical leakage detectors, among other types of detectors within the scope of the present disclosure. A thermal detector (or temperature sensor) may provide temperature information about the fluid in the flow line, temperature information about the flow-line tube, and may provide information to calibrate the resistivity measurements at specific temperatures and/or across particular temperature ranges. Electrical, voltage, and/or current detectors may assist in detecting the resistivity of the fluid within the flow-line tube and/or may be used to make other measurements and/or provide monitoring for the apparatus or other downhole tools. An electrical leakage detector may be configured in connection with the flow-line tube such that cracks and/or sources of current leakage from the flow-line tube may be detected and may notify an operator of a defect within the apparatus.

Figure 6:
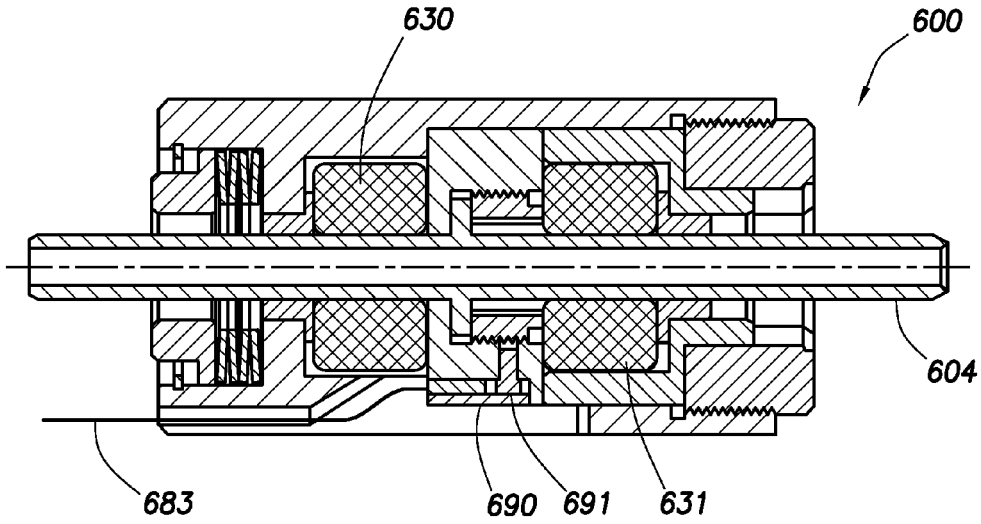
FIG. 6 is a schematic view of apparatus according to one or more aspects of the present disclosure.

Referring to FIG. 6, a cross-sectional schematic view is shown of the apparatus 100, taken along line D-D of FIG. 2B. As shown, a detector 690 may be provided within the apparatus 100. The detector 690 may be configured to detect electrical current leaks that may occur from the flow-line tube 604. The detector 690 may be electrically coupled to a screw or other electrically conductive device and/or material that may be in electrical communication with the flow-line tube 604. If the flow-line tube 604 develops cracks, the detector 690 may detect the leaking current, and indicate to an operator a defect in the apparatus 100. The detector 690 may communicate with a computer and/or other electronic device (not shown) by one or more wires 683. The wires 683 may further be in electrical communication with the first winding 630 and/or the second winding 631.

Figure 7:
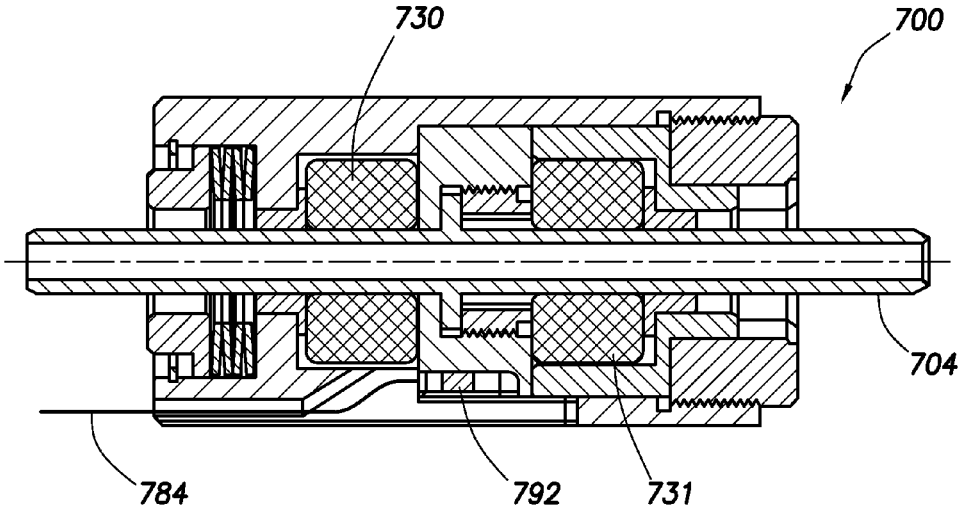
FIG. 7 is a schematic view of apparatus according to one or more aspects of the present disclosure.

Referring to FIG. 7, a cross-sectional schematic view is shown of the apparatus 100, taken along line E-E of FIG. 2B. As shown, a detector 792 may be provided within the apparatus 100. The detector 792 may be configured to detect a temperature within the apparatus 100 and/or a temperature of the flow-line tube 704. The detector 792 may communicate with a computer or other electronic device (not shown) by one or more wires 784. The wires 784 may also provide electrical communication for the first winding 730 and/or the second winding 731. The detector 792 may provide temperature information that may be used to calibrate a resistivity measurement for a given temperature and/or temperature range. The detector 792 may also provide temperature information about the flow-line tube 704 and/or temperature information about a fluid within the flow-line tube 704.

Figure 8:
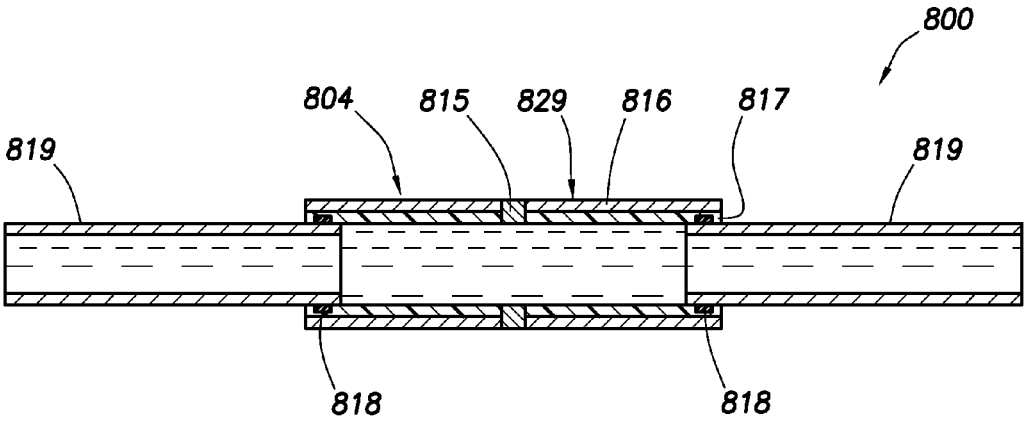
FIG. 8 is a schematic view of apparatus according to one or more aspects of the present disclosure.

Referring to FIG. 8, a schematic view is shown of an apparatus 800 in accordance with one or more aspects of the present disclosure. The apparatus 800 may provide a conductive method for measuring a resistivity of a fluid in a flow line. The apparatus 800 is merely representative of the flow-line tube 804 as connected to a flow line 819. One or more elements described above may be employed with apparatus 800, such as those shown in FIGS. 1-7.

The flow-line tube 804 may be fluidly connected to the flow line 819, and may be fluidly sealed thereto by O-rings 818. The flow-line tube 804 may include multiple layers, for example, an inner electrically insulated layer 817 and an outer structural layer 816. The outer structural layer 816 may provide the flow-line tube 804 with pressure resistance and/or protection from the fluid pressure applied by a fluid that may be within the flow-line tube 804. The inner insulated layer 817 may provide electrical insulation to the fluid within the flow-line tube 804 such that a current or voltage in the fluid within the flow-line tube 804 may be protected and shielded from external electrical signals and/or interference. Alternatively, the flow-line tube 804 may be made from a single unitary piece that may be structurally reinforced and electrically insulated.

The flow-line tube 804 may be separated into multiple sections. A first section 828 and a second section 829 may include insulated parts of the flow-line tube 804. Located between the first section 828 and the second section 829 may be a conductive section 815. The conductive section 815 may allow for a measurement of the resistivity of the fluid within the flow-line tube 804 by conduction.

As such, an apparatus according to one or more aspects of the present disclosure may be included within one or more tools and/or devices that may be disposed downhole within a subterranean formation.

Figure 9:
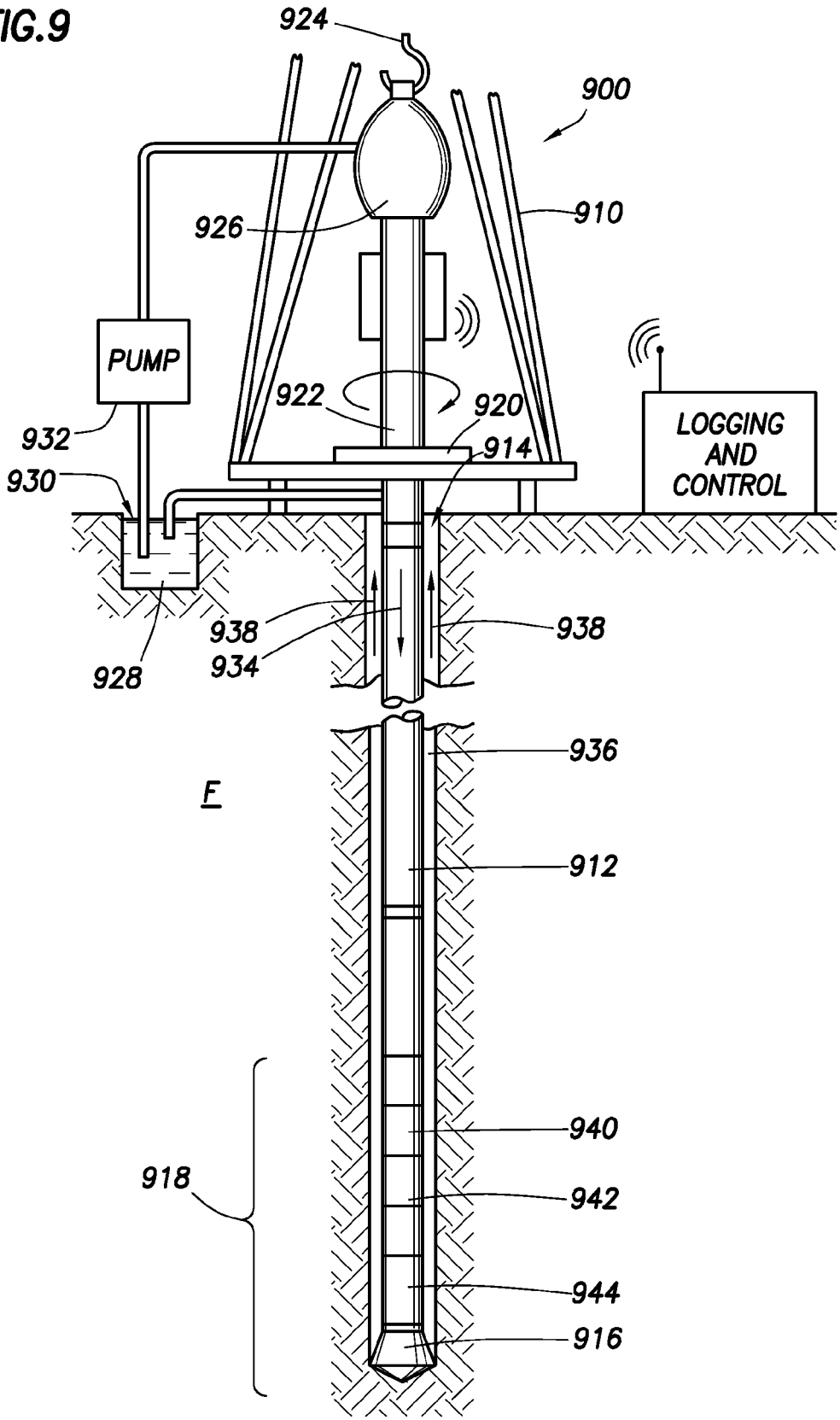
FIG. 9 is a schematic view of apparatus according to one or more aspects of the present disclosure.

Referring to FIG. 9, illustrated is a schematic view of a wellsite 900 having a drilling rig 910 with a drill string 912 suspended therefrom in accordance with one or more aspects of the present disclosure. The wellsite 900 shown, or one similar thereto, may be used within onshore and/or offshore locations. In this embodiment, a wellbore 914 may be formed within a subterranean formation F, such as by using rotary drilling and/or other methods. As such, one or more embodiments in accordance with the present disclosure may be used within a wellsite, similar to the one as shown in FIG. 9 (discussed more below). Those having ordinary skill in the art will appreciate that the present disclosure may be used within other wellsites or drilling operations, such as within a directional drilling application, without departing from the scope of the present disclosure.

Continuing with FIG. 9, the drill string 912 may suspend from the drilling rig 910 into the wellbore 914. The drill string 912 may include a bottom hole assembly 918 and a drill bit 916, in which the drill bit 916 may be disposed at an end of the drill string 912. The surface of the wellsite 900 may have the drilling rig 910 positioned over the wellbore 914, and the drilling rig 910 may include a rotary table 920, a kelly 922, a traveling block or hook 924, and may additionally include a rotary swivel 926. The rotary swivel 926 may be suspended from the drilling rig 910 through the hook 924, and the kelly 922 may be connected to the rotary swivel 926 such that the kelly 922 may rotate with respect to the rotary swivel.

An upper end of the drill string 912 may be connected to the kelly 922, such as by threadingly connecting the drill string 912 to the kelly 922, and the rotary table 920 may rotate the kelly 922, thereby rotating the drill string 912 connected thereto. As such, the drill string 912 may be able to rotate with respect to the hook 924. Those having ordinary skill in the art, however, will appreciate that though a rotary drilling system is shown in FIG. 9, other drilling systems may be used without departing from the scope of the present disclosure. For example, a top-drive (also known as a "power swivel") system may be used without departing from the scope of the present disclosure. In such a top-drive system, the hook 924, swivel 926, and kelly 922 are replaced by a drive motor (electric or hydraulic) that may apply rotary torque and axial load directly to drill string 912.

The wellsite 900 may include drilling fluid 928 (also known as drilling "mud") stored in a pit 930. The pit 930 may be formed adjacent to the wellsite 900, as shown, in which a pump 932 may be used to pump the drilling fluid 928 into the wellbore 914. The pump 932 may pump and deliver the drilling fluid 928 into and through a port of the rotary swivel 926, thereby enabling the drilling fluid 928 to flow into and downwardly through the drill string 912, the flow of the drilling fluid 928 indicated generally by direction arrow 934. This drilling fluid 928 may then exit the drill string 912 through one or more ports disposed within and/or fluidly connected to the drill string 912. For example, the drilling fluid 928 may exit the drill string 912 through one or more ports formed within the drill bit 916.

As such, the drilling fluid 928 may flow back upwardly through the wellbore 914, such as through an annulus 936 formed between the exterior of the drill string 912 and the interior of the wellbore 914, the flow of the drilling fluid 928 indicated generally by direction arrow 938. With the drilling fluid 928 following the flow pattern of direction arrows 934 and 938, the drilling fluid 928 may be able to lubricate the drill string 912 and the drill bit 916, and/or may be able to carry formation cuttings formed by the drill bit 916 (or formed by other drilling components disposed within the wellbore 914) back to the surface of the wellsite 900. As such, this drilling fluid 928 may be filtered and cleaned and/or returned back to the pit 930 for recirculation within the wellbore 914.

Though not shown, the drill string 912 may include one or more stabilizing collars. A stabilizing collar may be disposed within and/or connected to the drill string 912, in which the stabilizing collar may be used to engage and apply a force against the wall of the wellbore 914. This may enable the stabilizing collar to prevent the drill string 912 from deviating from the desired direction for the wellbore 914. For example, during drilling, the drill string 912 may "wobble" within the wellbore 914, thereby enabling the drill string 912 to deviate from the desired direction of the wellbore 914. This wobble may also be detrimental to the drill string 912, components disposed therein, and the drill bit 916 connected thereto. However, a stabilizing collar may be used to minimize, if not overcome altogether, the wobble action of the drill string 912, thereby possibly increasing the efficiency of the drilling performed at the wellsite 900 and/or increasing the overall life of the components at the wellsite 900.

As discussed above, the drill string 912 may include a bottom hole assembly 918, such as by having the bottom hole assembly 918 disposed adjacent to the drill bit 916 within the drill string 912. The bottom hole assembly 918 may include one or more components included therein, such as components to measure, process, and/or store information. The bottom hole assembly 918 may include components to communicate and/or relay information to the surface of the wellsite.

As such, as shown in FIG. 9, the bottom hole assembly 918 may include one or more logging-while-drilling ("LWD") tools 940 and/or one or more measuring-while-drilling ("MWD") tools 942. The bottom hole assembly 918 may also include a steering-while-drilling system (e.g., a rotary-steerable system) and motor 944, in which the rotary-steerable system and motor 944 may be coupled to the drill bit 916.

The LWD tool 940 shown in FIG. 9 may include a thick-walled housing, commonly referred to as a drill collar, and may include one or more logging tools. Thus, the LWD tool 940 may be capable of measuring, processing, and/or storing information therein, as well as capabilities for communicating with equipment disposed at the surface of the wellsite 900.

The MWD tool 942 may also include a housing (e.g., drill collar), and may include one or more measuring tools, such as tools used to measure characteristics of the drill string 912 and/or the drill bit 916. The MWD tool 942 may also include an apparatus for generating and distributing power within the bottom hole assembly 918. For example, a mud turbine generator powered by flowing drilling fluid therethrough may be disposed within the MWD tool 942. Alternatively, other power generating sources and/or power storing sources (e.g., a battery) may be disposed within the MWD tool 942 to provide power within the bottom hole assembly 918. As such, the MWD tool 942 may include one or more of the following measuring tools: a weight-on-bit measuring device, a torque measuring device, a vibration measuring device, a shock measuring device, a stick slip measuring device, a direction measuring device, an inclination measuring device, and/or other devices used within an MWD tool.

According to one or more aspects of the present disclosure, the LWD tool 940 may comprise a carrier module having a sample chamber for conveying an injection fluid into the wellbore 914. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port. The LWD tool 940 may be used to inject fluid from the sample chamber into the formation F as described herein.

Figure 10:
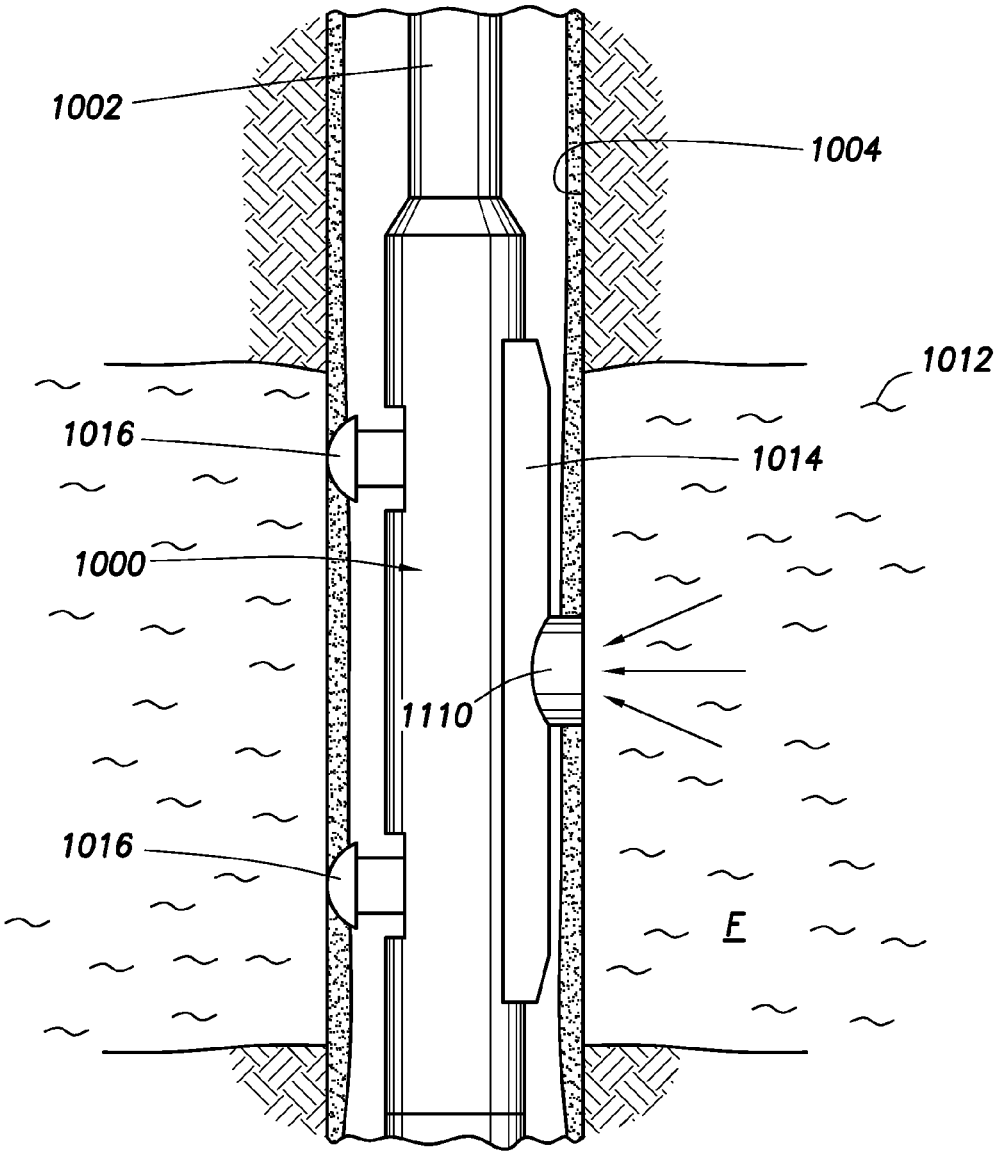
FIG. 10 is a schematic view of apparatus according to one or more aspects of the present disclosure.

Referring to FIG. 10, illustrated is a schematic view of a tool 1000 in accordance with one or more aspects of the present disclosure. The tool 1000 may be connected to and/or included within a drill string 1002, in which the tool 1000 may be disposed within a wellbore 1004 formed within a subterranean formation F. As such, the tool 1000 may be included and used within a bottom hole assembly, as described above.

Particularly, the tool 1000 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 1000 may include a probe 1010 to hydraulically establish communication with the subterranean formation F and draw formation fluid 1012 into the tool 1000.

The tool 1000 may also include a stabilizer blade 1014 and/or one or more pistons 1016. As such, the probe 1010 may be disposed on the stabilizer blade 1014 and extend therefrom to engage the wall of the wellbore 1004. The pistons, if present, may also extend from the tool 1000 to assist probe 1010 in engaging with the wall of the wellbore 1004. Alternatively, though, the probe 1010 may not necessarily engage the wall of the wellbore 1004 when drawing fluid.

As such, fluid 1012 drawn into the tool 1000 may be measured to determine one or more parameters of the subterranean formation F, such as pressure and/or pretest parameters of the subterranean formation F. Additionally, the tool 1000 may include one or more devices, such as sample chambers or sample bottles, which may be used to collect formation fluid samples. These formation fluid samples may be retrieved back at the surface with the tool 1000. Alternatively, rather than collecting formation fluid samples, the formation fluid 1012 received within the tool 1000 may be circulated back out into the subterranean formation F and/or wellbore 1004. As such, a pumping system may be included within the tool 1000 to pump the formation fluid 1012 circulating within the tool 1000. For example, the pumping system may be used to pump formation fluid 1012 from the probe 1010 to the sample bottles and/or back into the formation F.

According to one or more aspects of the present disclosure, the tool 1000 may be used to inject fluid through the probe 1010 and into the formation F as described herein. As such, the tool 1000 may comprise a carrier module having a sample chamber for conveying an injection fluid into the wellbore 1004. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port.

Figure 11:
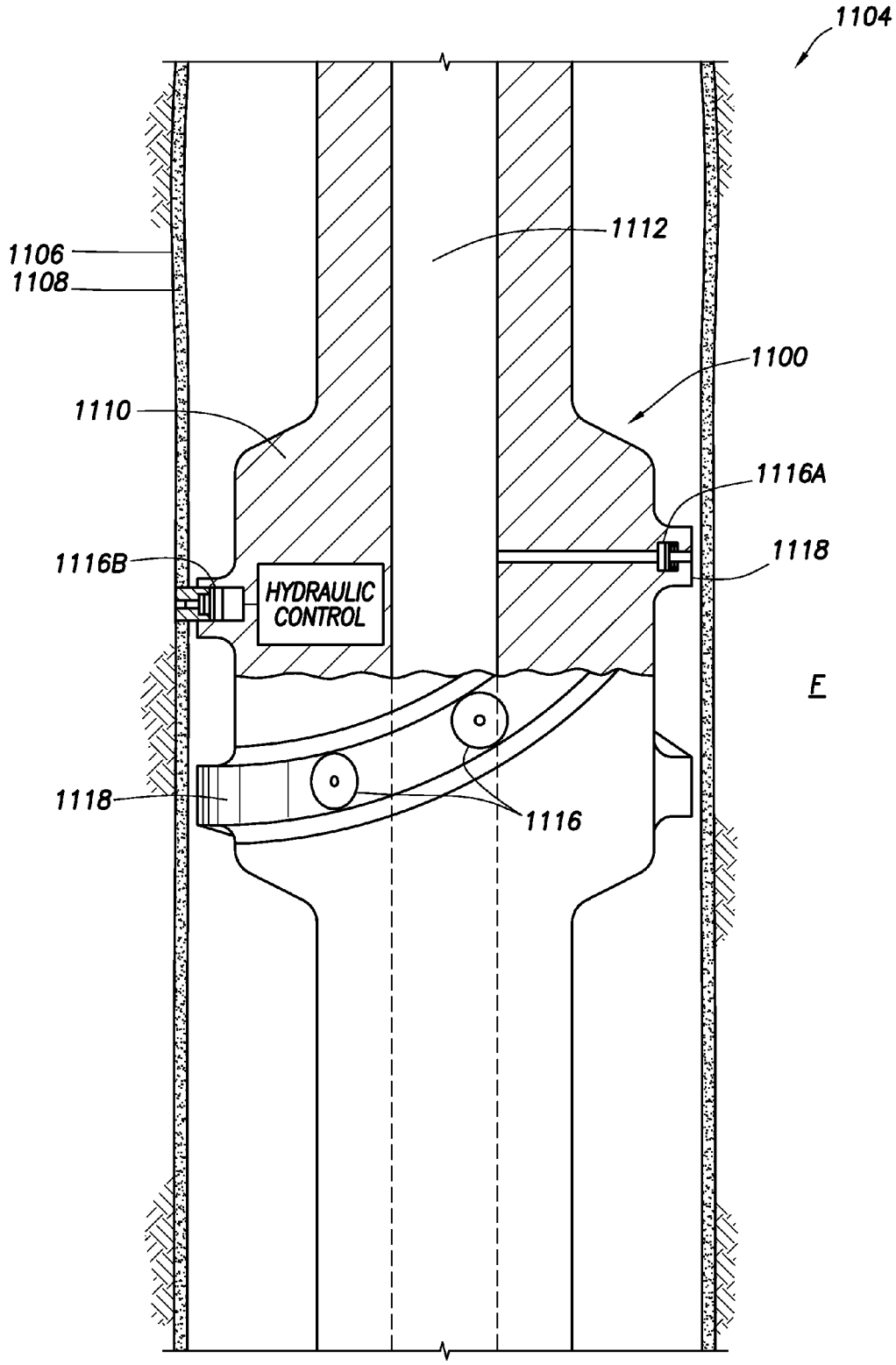
FIG. 11 is a schematic view of apparatus according to one or more aspects of the present disclosure.

Referring to FIG. 11, illustrated is a schematic view of a tool 1100 in accordance with one or more aspects of the present disclosure. The tool 1100 may be connected to and/or included within a bottom hole assembly, in which the tool 1100 may be disposed within a wellbore 1104 formed within a subterranean formation F.

The tool 1100 may be a pressure LWD tool used to measure one or more downhole pressures, including annular pressure, formation pressure, and pore pressure, before, during, and/or after a drilling operation. Those having ordinary skill in the art will appreciate that other pressure LWD tools may also be utilized in one or more aspects, such as that described within U.S. Pat. No. 6,986,282, filed on Feb. 18, 2003, entitled "Method and Apparatus for Determining Downhole Pressures During a Drilling Operation," and incorporated herein by reference in its entirety.

As shown, the tool 1100 may be formed as a modified stabilizer collar 1110, similar to a stabilizer collar as described above, and may have a passage 1112 formed therethrough for drilling fluid. The flow of the drilling fluid through the tool 1100 may create an internal pressure $P_1$, and the exterior of the tool 1100 may be exposed to an annular pressure $P_A$ of the surrounding wellbore 1104 and formation F. A differential pressure $P_\delta$ formed between the internal pressure $P_1$ and the annular pressure $P_A$ may then be used to activate one or more pressure devices 1116 that may be included within the tool 1100.

The tool 1100 may include two pressure measuring devices 1116A and 1116B that may be disposed on stabilizer blades 1118 formed on the stabilizer collar 1110. The pressure measuring device 1116A may be used to measure the annular pressure $P_A$ in the wellbore 1104, and/or may be used to measure the pressure of the formation F when positioned in engagement with a wall 1106 of the wellbore 1104. As shown in FIG. 11, the pressure measuring device 1116A is not in engagement with the wellbore wall 1106, thereby enabling the pressure measuring device 1116A to measure the annular pressure $P_A$, if desired. However, when the pressure measuring device 1116A is moved into engagement with the wellbore wall 1106, the pressure measuring device 1116A may be used to measure pore pressure of the formation F.

As also shown in FIG. 11, the pressure measuring device 1116B may be extendable from the stabilizer blade 1118, such as by using a hydraulic control disposed within the tool 1100. When extended from the stabilizer blade 1118, the pressure measuring device 1116B may establish sealing engagement with the wall 1106 of the wellbore 1104 and/or a mudcake 1208 of the wellbore 1104. This may also enable the pressure measuring device 1116B to take measurements of the formation F. Other controllers and circuitry, not shown, may be used to couple the pressure measuring devices 1116 and/or other components of the tool 1100 to a processor and/or a controller. The processor and/or controller may then be used to communicate the measurements from the tool 1100 to other tools within a bottom hole assembly or to the surface of a wellsite. As such, a pumping system may be included within the tool 1100, such as including the pumping system within one or more of the pressure devices 1116 for activation and/or movement of the pressure devices 1116.

Figure 12:
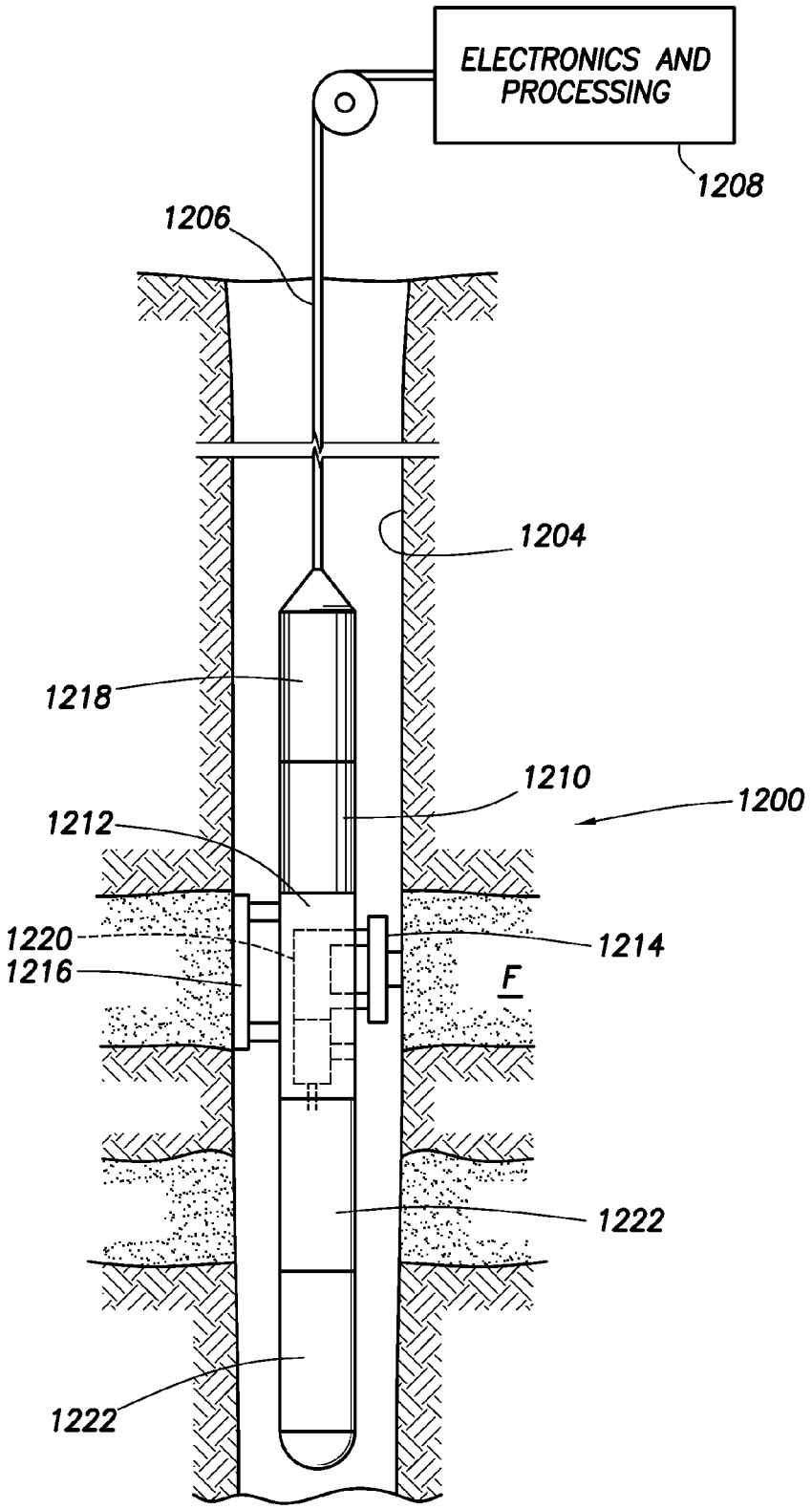
FIG. 12 is a schematic view of apparatus according to one or more aspects of the present disclosure.

Referring to FIG. 12, illustrated is a side view of a tool 1200 in accordance with one or more aspects of the present disclosure. The tool 1200 may be a "wireline" tool, in which the tool 1200 may be suspended within a wellbore 1204 formed within a subterranean formation F. As such, the tool 1200 may be suspended from an end of a multi-conductor cable 1206 located at the surface of the formation F, such as by having the multi-conductor cable 1206 spooled around a winch (not shown) disposed on the surface of the formation F. The multi-conductor cable 1206 is then coupled the tool 1200 with an electronics and processing system 1208 disposed on the surface.

The tool 1200 may have an elongated body 1210 that includes a formation tester 1212 disposed therein. The formation tester 1212 may include an extendable probe 1214 and an extendable anchoring member 1216, in which the probe 1214 and anchoring member 1216 may be disposed on opposite sides of the body 1210. One or more other components 1218, such as a measuring device, may also be included within the tool 1200.

The probe 1214 may be included within the tool 1200 such that the probe 1214 may be able to extend from the body 1210 and then selectively seal off and/or isolate selected portions of the wall of the wellbore 1204. This may enable the probe 1214 to establish pressure and/or fluid communication with the formation F to draw fluid samples from the formation F. The tool 1200 may also include a fluid analysis tester 1220 that is in fluid communication with the probe 1214, thereby enabling the fluid analysis tester 1220 to measure one or more properties of the fluid. The fluid from the probe 1214 may also be sent to one or more sample chambers or bottles 1222, which may receive and retain fluids obtained from the formation F for subsequent testing after being received at the surface. The fluid from the probe 1214 may also be sent back out into the wellbore 1204 or formation F.

Figure 13:
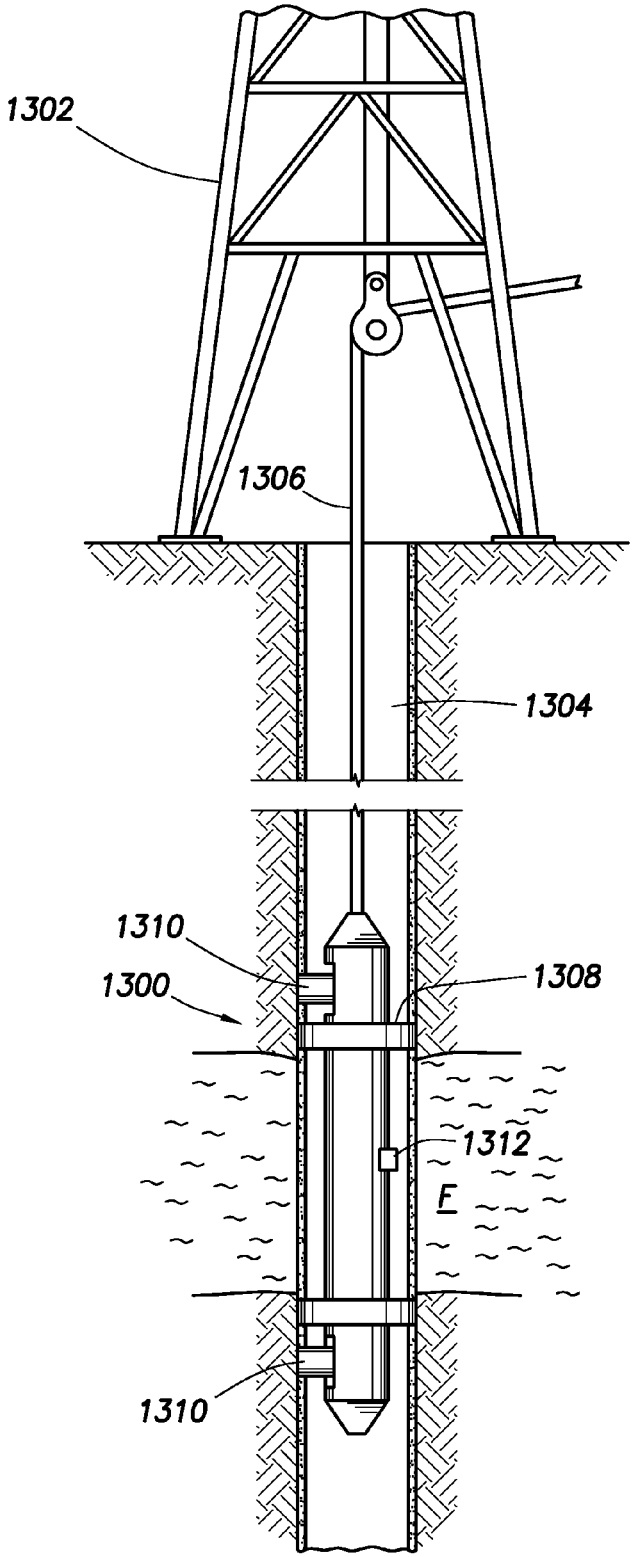
FIG. 13 is a schematic view of apparatus according to one or more aspects of the present disclosure.

Referring to FIG. 13, illustrated is a side view of another tool 1300 in accordance with one or more aspects of the present disclosure. The tool 1300 may be suspended within a wellbore 1304 formed within a subterranean formation F using a multi-conductor cable 1306. The multi-conductor cable 1306 may be supported by a drilling rig 1302.

The tool 1300 may include one or more packers 1308 that may be configured to inflate, thereby selectively sealing off a portion of the wellbore 1304 for the tool 1300. To test the formation F, the tool 1300 may include one or more probes 1310, and the tool 1300 may also include one or more outlets 1312 that may be used to inject fluids within the sealed portion established by the packers 1308 between the tool 1300 and the formation F.

Figure 14:
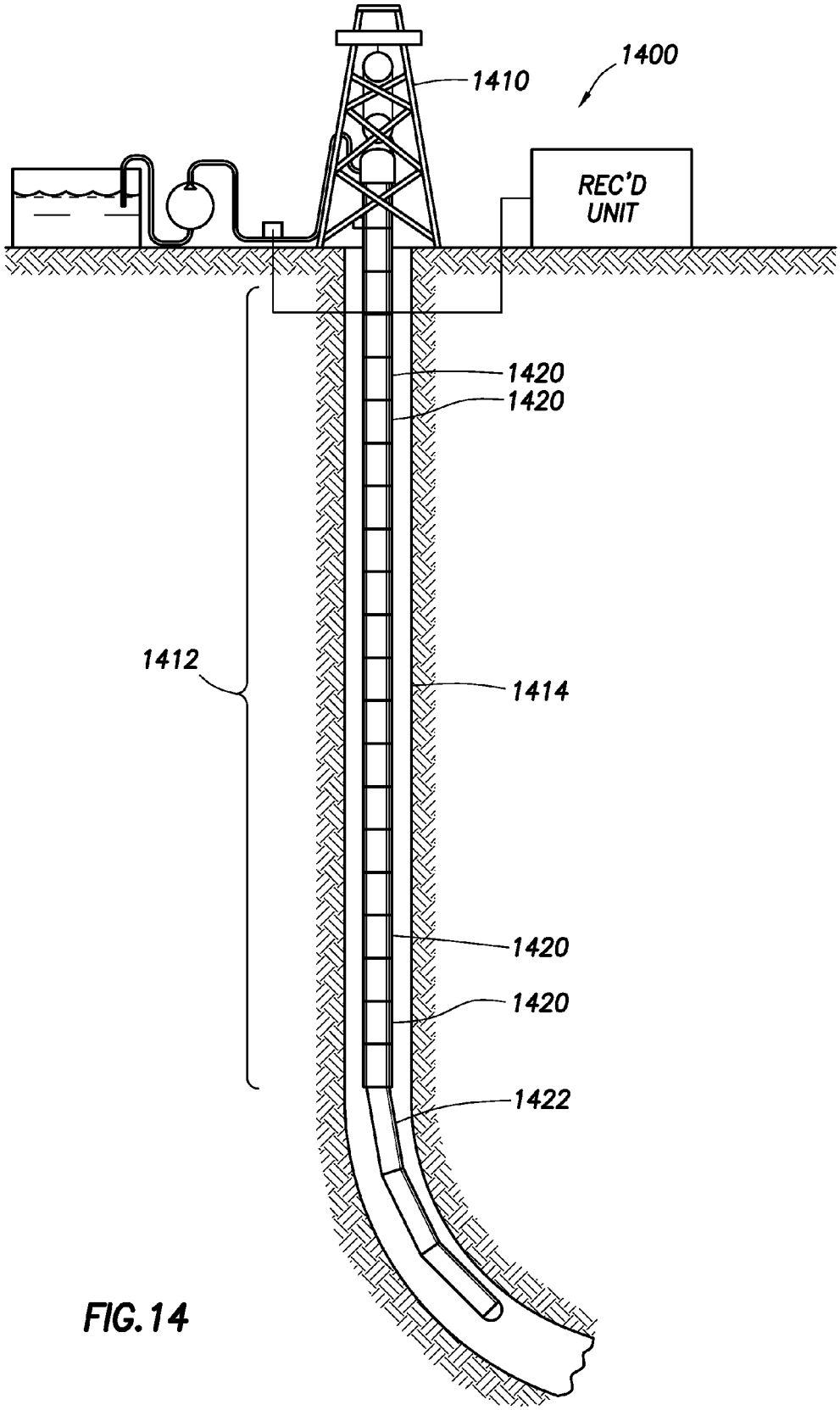
FIG. 14 is a schematic view of apparatus according to one or more aspects of the present disclosure.

Referring to FIG. 14, illustrated is a side view of a wellsite 1400 having a drilling rig 1410 in accordance with one or more aspects of the present disclosure. A wellbore 1414 may be formed within a subterranean formation F, such as by using a drilling assembly. A wired pipe string 1412 may be suspended from the drilling rig 1410. The wired pipe string 1412 may be extended into the wellbore 1414 by threadably coupling multiple segments 1420 (i.e., joints) of wired drill pipe together in an end-to-end fashion. As such, the wired drill pipe segments 1420 may be similar to that as described within U.S. Pat. No. 6,641,434, filed on May 31, 2002, entitled "Wired Pipe Joint with Current-Loop Inductive Couplers," and incorporated herein by reference in its entirety.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and/or other cables. The wired drill pipe may include having a form of signal coupling, such as having inductive coupling, to communicate data and/or signals between adjacent pipe segments assembled together.

As such, the wired pipe string 1412 may include one or more tools 1422 and/or instruments disposed within the pipe string 1412. For example, as shown in FIG. 14, a string of multiple wellbore tools 622 may be coupled to a lower end of the wired pipe string 1412. The tools 1422 may include one or more tools used within wireline applications, may include one or more LWD tools, may include one or more formation evaluation or sampling tools, and/or may include other tools capable of measuring a characteristic of the formation F.

The tools 1422 may be connected to the wired pipe string 612 during drilling the wellbore 1414, or, if desired, the tools 1422 may be installed after drilling the wellbore 1414. If installed after drilling the wellbore 1414, the wired pipe string 1412 may be brought to the surface to install the tools 1422, or, alternatively, the tools 1422 may be connected or positioned within the wired pipe string 1412 using other methods, such as by pumping or otherwise moving the tools 1422 down the wired pipe string 1412 while still within the wellbore 1414. The tools 1422 may then be positioned within the wellbore 1414, as desired, through the selective movement of the wired pipe string 1412, in which the tools 1422 may gather measurements and data. These measurements and data from the tools 1422 may then be transmitted to the surface of the wellbore 1414 using the cable within the wired drill pipe 1412.

Accordingly, apparatus as described in FIGS. 1-8 may be employed in downhole tools as described in FIGS. 9-15, among other downhole tools and/or equipment within the scope of the present disclosure.

In view of all of the above and the figures, those skilled in the art should readily recognize that the present disclosure introduces an apparatus including a housing, a cap removably attached to an end of the housing, a flow-line tube disposed within the housing, a first winding disposed within the housing and adjacent to the flow-line tube at a first position, and a second winding disposed within the housing and adjacent to the flow-line tube at a second position, in which the first winding is configured to induce an electrical current in a fluid within the flow-line tube. The second winding may be configured to detect the electrical current in the fluid within the flow-line tube. The apparatus may further include a first chassis and a second chassis in which the housing is disposed between the first chassis and the second chassis. The first chassis may comprise a first flow-line extending therethrough, the second chassis may comprise a second flow-line extending therethrough, and the flow-line tube may fluidly couple the first flow-line to the second flow-line. The apparatus may further include a biasing member disposed between the housing and the first chassis. The apparatus may further comprise a spacer disposed between the housing and the first chassis. The cap may be threadedly connected to the end of the housing. The flow-line tube may be electrically insulated.

The flow-line tube may comprise a first diameter and a second diameter, and the second diameter may be larger than the first diameter and may be disposed between the first winding and the second winding. The second diameter may comprise a flange. The flange may be removably connected to the flow-line tube. The second diameter may comprise an insulated ring. The housing may comprise a non-magnetic material. The apparatus may further comprise a detector disposed within the housing. The detector may be thermally coupled to the flow-line tube and may be configured to detect a temperature of the flow-line tube. The detector may be electrically coupled to the flow-line tube and may be configured to detect an electrical leakage within the flow-line tube. The detector may be electrically coupled to the second winding and may be configured to detect a current induced in the fluid within the flow-line tube. The detector may be electrically coupled to the second winding and may be configured to detect a voltage of the fluid within the flow-line tube.

The present disclosure also introduces a method comprising providing a housing, removably attaching a cap to an end of the housing, disposing a flow-line tube within the housing, disposing a first winding within the housing adjacent to the flow-line tube at a first position, and disposing a second winding within the housing adjacent to the flow-line tube at a second position, the first winding may be configured to induce an electrical current in a fluid within the flow-line tube. The second winding may be configured to detect the electrical current in the fluid within the flow-line tube. The method may further comprise disposing the housing between a first chassis and a second chassis. The method may further comprise disposing a biasing mechanism between the housing and the first chassis. The method may further comprise threadedly connecting the cap to the housing.

The present disclosure also introduces an apparatus comprising a housing, a cap removably attached to an end of the housing, a flow-line tube disposed within the housing, the flow-line tube comprising, a first insulated portion, a second insulated portion, and a conductive portion, in which the conductive portion is disposed between the first insulated portion and the second insulated portion. The apparatus may further comprise a first chassis and a second chassis, in which the housing is disposed between the first chassis and the second chassis. The apparatus may further comprise a biasing member disposed between the housing and the first chassis. The apparatus may further comprise a detector electrically coupled to the conductive portion and may be configured to measure one of an electrical current and an electrical voltage through the conductive portion.

The present disclosure also introduces a method comprising providing a housing, removably attaching a cap to an end of the housing, disposing a flow-line tube within the housing, the flow-line tube may comprise a first insulated portion, a second insulated portion, and a conductive portion, in which the conductive portion is disposed between the first insulated portion and the second insulated portion, and measuring one of a current and a voltage at the conductive portion. The method may further comprise disposing the housing between a first chassis and a second chassis. The method may further comprise disposing a biasing mechanism between the housing and the first chassis. The cap may be threadedly connected to the housing.

The present disclosure also introduces an apparatus comprising: a downhole tool configured for conveyance within a borehole extending into a subterranean formation, wherein the downhole tool comprises a sensor assembly comprising: a housing; a cap removably coupled to an end of the housing; a flow-line tube disposed within the housing and configured to receive fluid from the formation or the borehole; a first winding disposed within the housing and configured to induce an electrical current in the fluid; and a second winding disposed within the housing and configured to detect the electrical current induced in the fluid by the first winding. The flow-line tube may extend externally from the housing and the cap. The sensor assembly may further comprise: a first chassis comprising a first flow-line extending therethrough; and a second chassis coupled to the first chassis and comprising a second flow-line extending therethrough, wherein the housing is disposed between the first and second chassis, and wherein the flow-line tube fluidly couples the first and second flow-lines. The sensor assembly may further comprise a biasing member disposed between the housing and the first chassis. The flow-line tube may be electrically insulated. The flow-line tube may comprise a first portion having a first diameter and a second portion having a second diameter, wherein the second diameter is larger than the first diameter, and wherein the second portion is disposed between the first and second windings. The second portion may be removably coupled to the first portion. The housing may comprise a non-magnetic material. The sensor assembly may further comprise a detector thermally coupled to the flow-line tube and configured to detect a temperature of the flow-line tube. The sensor assembly may further comprise a detector electrically coupled to the flow-line tube and configured to detect an electrical leakage from the flow-line tube. The sensor assembly may further comprise a detector electrically coupled to the second winding and configured to detect a current of the second winding. The sensor assembly may further comprise a detector electrically coupled to the second winding and configured to detect a voltage of the second winding. The downhole tool may be configured for conveyance within the borehole via drill string or wireline.

The present disclosure also introduces a method comprising: conveying a downhole tool within a borehole extending into a subterranean formation, wherein the downhole tool comprises a sensor assembly comprising: a housing; a cap removably coupled to an end of the housing; a flow-line tube disposed within the housing; a first winding disposed within the housing adjacent the flow-line tube; and a second winding disposed within the housing adjacent the flow-line tube; drawing fluid from the formation or the borehole into the downhole tool and through the flow-line tube; inducing an electrical current in the fluid within the flow-line tube; and detecting the electrical current induced in the formation fluid by the first winding. The method may further comprise detecting a temperature of the flow-line tube with a detector thermally coupled to the flow-line tube. The method may further comprise detecting an electrical leakage from the flow-line tube with a detector electrically coupled to the flow-line tube. The method may further comprise detecting a current of the second winding with a detector electrically coupled to the second winding. The method may further comprise detecting a voltage of the second winding with a detector electrically coupled to the second winding. Conveying the downhole tool within the borehole may comprise conveyance via one of wireline and drill string.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance within a borehole extending into a subterranean formation, wherein the downhole tool comprises a sensor assembly comprising:

a housing;

a cap removably coupled to an end of the housing;

a flow-line tube disposed within the housing and configured to receive fluid from the formation or borehole;

a first winding disposed within the housing and configured to induce an electrical current in the fluid; and a second winding disposed within the housing and configured to detect the electrical current induced in the fluid by the first winding;

a first chassis comprising a first flow-line extending therethrough; and a second chassis coupled to the first chassis and comprising a second flow-line extending therethrough, wherein the housing is disposed between the first and second chassis, and wherein the flow-line tube fluidly couples the first and second flow-lines.

2. The apparatus of claim 1 wherein the flow-line tube extends externally from the housing and the cap.

3. The apparatus of claim 1 wherein the sensor assembly further comprises a biasing member disposed between the housing and the first chassis.

4. The apparatus of claim 1 wherein the flow-line tube is electrically insulated.

5. The apparatus of claim 1 wherein the flow-line tube comprises a first portion having a first diameter and a second portion having a second diameter, wherein the second diameter is larger than the first diameter, and wherein the second portion is disposed between the first and second windings.

6. The apparatus of claim 5 wherein the second portion is removably coupled to the first portion.

7. The apparatus of claim 1 wherein the housing comprises a non-magnetic material.

8. The apparatus of claim 1 wherein the sensor assembly further comprises a detector thermally coupled to the flow-line tube and configured to detect a temperature of the flow-line tube.

9. The apparatus of claim 1 wherein the sensor assembly further comprises a detector electrically coupled to the flow-line tube and configured to detect an electrical leakage from the flow-line tube.

10. The apparatus of claim 1 wherein the sensor assembly further comprises a detector electrically coupled to the second winding and configured to detect a current of the second winding.

11. The apparatus of claim 1 wherein the sensor assembly further comprises a detector electrically coupled to the second winding and configured to detect a voltage of the second winding.

12. The apparatus of claim 1 wherein the downhole tool is configured for conveyance within the borehole via drill string.

13. The apparatus of claim 1 wherein the downhole tool is configured for conveyance within the borehole via wireline.

14. A method, comprising:

conveying a downhole tool within a borehole extending into a subterranean formation, wherein the downhole tool comprises a sensor assembly comprising:

a housing;

a cap removably coupled to an end of the housing;

a flow-line tube disposed within the housing;

a first winding disposed within the housing adjacent the flow-line tube; and a second winding disposed within the housing adjacent the flow-line tube;

drawing fluid from the formation or borehole into the downhole tool and through the flow-line tube;

inducing an electrical current in the fluid within the flow-line tube;

detecting the electrical current induced in the fluid by the first winding; and detecting an electrical leakage from the flow-line tube with a detector electrically coupled to the flow-line tube.

15. The method of claim 14 further comprising detecting a temperature of the flow-line tube with a detector thermally coupled to the flow-line tube.

16. The method of claim 14 further comprising detecting a current of the second winding with a detector electrically coupled to the second winding.

17. The method of claim 14 further comprising detecting a voltage of the second winding with a detector electrically coupled to the second winding.

18. The method of claim 14 wherein conveying the downhole tool within the borehole comprises conveyance via one of wireline and drill string.

* * * * *